US008571458B2

(12) United States Patent
Okada

(10) Patent No.: US 8,571,458 B2
(45) Date of Patent: Oct. 29, 2013

(54) FIXING DEVICE WITH A PLURALITY OF CORE BODIES AND IMAGE FORMING APPARATUS INCLUDING THE SAME

(75) Inventor: Seiji Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 309 days.

(21) Appl. No.: 13/013,868

(22) Filed: Jan. 26, 2011

(65) Prior Publication Data

US 2011/0182637 A1 Jul. 28, 2011

(30) Foreign Application Priority Data

Jan. 28, 2010 (JP) ..... 2010-016315

(51) Int. Cl.
*G03G 15/20* (2006.01)

(52) U.S. Cl.
USPC ..... 399/329; 399/334

(58) Field of Classification Search
USPC ..... 219/619; 399/329, 330, 333, 334
See application file for complete search history.

(56) References Cited

U.S. PATENT DOCUMENTS

| | | | | |
|---|---|---|---|---|
| 2007/0014599 | A1 | 1/2007 | Yasuda et al. | |
| 2009/0245898 | A1 * | 10/2009 | Gon et al. | 399/328 |
| 2009/0285609 | A1 | 11/2009 | Hayashi | |

FOREIGN PATENT DOCUMENTS

| | | |
|---|---|---|
| JP | 04-129943 | 4/1992 |
| JP | 2006-171273 | 6/2006 |
| JP | 2009-301019 | 12/2009 |
| JP | 2010-008892 | 1/2010 |
| WO | WO2005/038535 | 4/2005 |

* cited by examiner

*Primary Examiner* — Hoang Ngo
(74) *Attorney, Agent, or Firm* — Frommer Lawrence & Haug LLP

(57) ABSTRACT

A fixing device includes a coil disposed along an outer surface of a heating member and configured to generate magnetic flux for heating the heating member through induction heating; and a core unit being configured to constitute a part of a magnetic path around the coil. The core unit includes a plurality of core bodies arranged in a width direction of a recording medium to be conveyed, the core bodies being made of magnetic material; and a shaft having an outer surface on which the core bodies are arranged, a length of the outer surface being longer than a sum of lengths of the core bodies arranged thereon, the core body lengths including axial tolerances of the core bodies. A gap is provided between any adjacent ones of the core bodies.

19 Claims, 9 Drawing Sheets

FIXING DEVICE WITH A PLURALITY OF CORE BODIES AND IMAGE FORMING APPARATUS INCLUDING THE SAME

INCORPORATION BY REFERENCE

This application is based upon and claims the benefit of priority from the corresponding Japanese Patent application No. 2010-016315, filed Jan. 28, 2010, the entire contents of which are incorporated herein by reference.

FIELD OF THE INVENTION

The present disclosure relates to a fixing device that fixes an unfixed toner image on a recording medium bearing the toner image by heating and fusing the toner image while the recording medium is passed through a nip between fixing rollers or between a heating belt and a roller. The present disclosure also relates to an image forming apparatus including the fixing device.

BACKGROUND OF THE INVENTION

In recent years, due to demand for energy saving and shorter warm-up time (i.e., the amount of time between when the image forming apparatus is turned on and when the fixing device can start the fixing operation) in a fixing device, image forming apparatuses using a belt-type fixing method in which smaller heat capacities can be set have attracted attention. Also in recent years, image forming apparatuses using an electromagnetic induction heating method which provides quick heating and high-efficiency heating have attracted attention. In the context of saving energy required for fixing color images, many products that combine the belt-type fixing method with the electromagnetic induction heating method have been commercially available. When the belt-type fixing method and the electromagnetic induction heating method are combined, a device that generates magnetic flux for electromagnetic induction is often provided outside a belt (so-called external induction heating (IH)). The use of this arrangement is advantageous in that a coil can be easily laid out and cooled and the belt can be directly heated.

In the electromagnetic induction heating method described above, various techniques have been developed to prevent overheating in a non-sheet-passing region in accordance with the width of a sheet that passes through the fixing device (sheet passing width). In particular, a size switching technique in external IH is known. In this technique, a ferrite center core that constitutes a part of a magnetic path is provided around a coil. As the center core rotates, a selection is made as to whether the belt is to be subjected to induction heating caused by magnetic flux generated by the coil, or induction heating is to be suppressed by cutting off the magnetic flux. With this technique, the amount of heat generation in the belt in the non-sheet-passing region can be set to a value different from that in the sheet passing region.

To create a magnetic path in a region for a maximum sheet size, the center core is formed as a single long narrow body that extends along the rotational axis thereof. In this case, unless the center core is manufactured with high accuracy, rotational vibrations of the center core may become large and variations in distance between the center core and the belt may be caused, and may thereby result in uneven heat generation in the belt in the direction of the rotational axis of the belt. If the center core is manufactured by cutting, it may be difficult to reduce manufacturing costs. If the center core is molded with a mold, high dimensional accuracy may not be achievable. Therefore, it is possible to divide the center core into a plurality of core bodies, which are then arranged on a shaft.

However, above-mentioned conventional technique still needs to be improved in terms of assembly of the center core. This is because when the center core is divided into a plurality of core bodies, there are manufacturing dimensional variations among the core bodies. Specifically, when the core bodies are manufactured by pressing and sintered powder, the shrinkage ratio (in the radial and axial directions) varies from one core body to another.

More specifically, when these separate core bodies are simply arranged on the shaft, core bodies located at both ends of the shaft will easily protrude from the shaft. In particular, when the core body is longer in the axial direction than in the radial direction, the influence of shrinkage ratio in the axial direction is more significant.

SUMMARY OF THE INVENTION

Accordingly, embodiments of the present disclosure provide a fixing device having a center core with improved assembly features and an image forming apparatus including the fixing device, and an object of some embodiments of the present disclosure is to solve the problems described above.

A fixing device according to an aspect of the present disclosure includes a coil disposed along an outer surface of a heating member and configured to generate magnetic flux for heating the heating member through induction heating; and a core unit being configured to constitute a part of a magnetic path around the coil. The core unit includes a plurality of core bodies arranged in a width direction of a recording medium to be conveyed, the core bodies being made of magnetic material; and a shaft having an outer surface on which the plurality of core bodies are arranged, a length of the outer surface being longer than a sum of lengths of the plurality of core bodies arranged on the outer surface, the core body lengths including axial tolerances of the plurality of core bodies. A gap is provided between any adjacent ones of the plurality of core bodies arranged on the shaft.

The above and other objects, features, and advantages of various embodiments of the present disclosure will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF THE EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present invention without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Embodiments of the present disclosure will now be described in detail with reference to the drawings.

Figure 1:
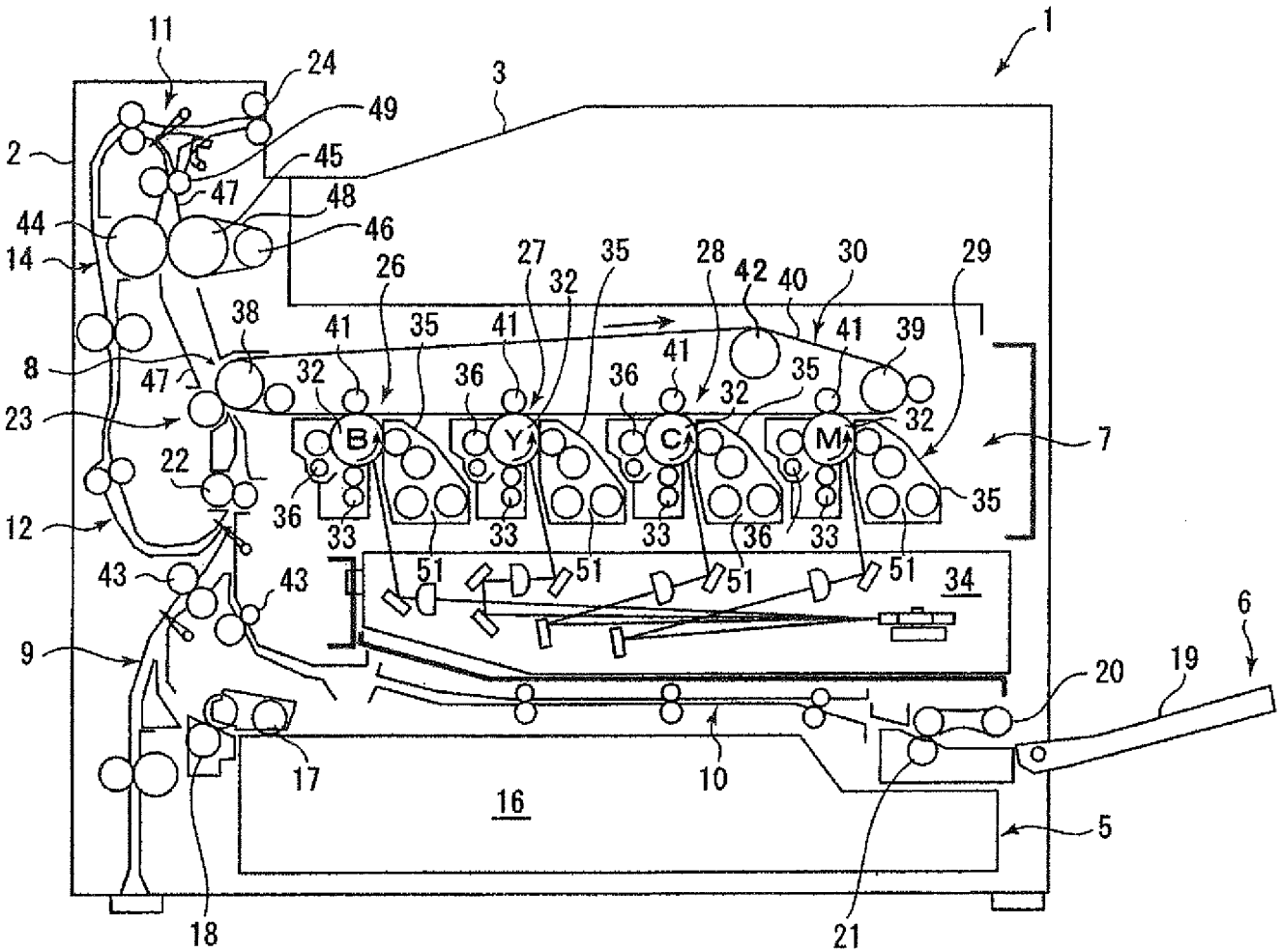
FIG. 1 is a schematic diagram illustrating a configuration of an image forming apparatus according to an embodiment.

FIG. 1 is a schematic diagram illustrating a configuration of an image forming apparatus 1 according to an embodiment. The image forming apparatus 1 may be, for example, a printer that is capable of performing a printing operation in which a toner image is transferred onto a surface of a sheet as a recording medium in accordance with image information externally input, a copier, a facsimile, or a multi-functional peripheral that combines these functions. In the following embodiments, the recording medium may be a sheet of paper, an overhead projector (OHP) sheet, or the like.

The image forming apparatus 1 illustrated in FIG. 1 is a tandem type color printer. The image forming apparatus 1 includes a rectangular box-shaped apparatus main body 2 in which color images are formed (printed) on sheets. The top surface of the apparatus main body 2 is provided with a discharge tray 3 onto which sheets with color images printed thereon are discharged.

A paper feed cassette 5 for accommodating sheets is disposed internally in a bottom part of the apparatus main body 2. A stacking tray 6 for feeding sheets not accommodated in the paper feed cassette 5 to the apparatus main body 2 is disposed at a right lateral side of the apparatus main body 2. An image forming section 7 is disposed in the center of the apparatus main body 2. The image forming section 7 fauns toner images on the basis of image data (including text and /or graphics) transmitted from a higher-level device, such as a personal computer (PC), connected to the image forming apparatus 1.

In a left part of the apparatus main body 2 in FIG. 1, there is a first conveying path 9 along which a sheet fed out of the paper feed cassette 5 is conveyed to a secondary transfer unit 23 (a transfer unit 8, described below). Also, there is a second conveying path 10 that extends from right to left in the apparatus main body 2. The second conveying path 10 is for conveying a sheet fed out of the stacking tray 6 to the secondary transfer unit 23. A fixing unit (fixing device) 14 and a third conveying path 11 are located internally in the upper left part of the apparatus main body 2. The fixing unit 14 performs a fixing process on a sheet onto which an image has been transferred by the secondary transfer unit 23. A sheet having been subjected to the fixing process is conveyed along the third conveying path 11 to the discharge tray 3.

When the paper feed cassette 5 is pulled out from the apparatus main body 2 (frontward in FIG. 1), sheets can be loaded in the paper feed cassette 5. The paper feed cassette 5 has a holding portion 16 that can hold one of at least two types of sheets that are different in size in the paper feed direction. Sheets held in the holding portion 16 are fed out one by one toward the first conveying path 9 by a paper feed roller 17 and a separating roller pair 18.

The stacking tray 6 can be opened and closed relative to the exterior of the apparatus main body 2. On a manual paper-feed portion 19 of the stacking tray 6, sheets are placed either one by one or together. The sheets placed on the manual paper-feed portion 19 are fed one by one toward the second conveying path 10 by a pick-up roller 20 and a separating roller pair 21.

The first conveying path 9 and the second conveying path 10 join before a registration roller pair 22. Upon reaching the registration roller pair 22, a sheet is temporarily held at this position, subjected to skew correction and timing adjustment, and fed toward the secondary transfer unit 23.

In the secondary transfer unit 23, a full-color toner image on an intermediate transfer belt 40 is secondary-transferred onto one side of the sheet. After the toner image is fixed by the fixing unit 14, the sheet is reversed, as necessary, on a fourth conveying path 12 and conveyed again to the secondary transfer unit 23, where a full-color toner image is secondary-transferred onto the other side of the sheet. After the toner image on the other side of the sheet is fixed by the fixing unit 14, the sheet with color images on both sides passes along the third conveying path 11 and is discharged by a discharge roller pair 24 to the discharge tray 3.

The image forming section 7 includes four image forming units 26, 27, 28, and 29 that form toner images of black (B), yellow (Y), cyan (C), and magenta (M), respectively. The image forming section 7 further includes an intermediate transfer unit (the transfer unit 8) 30 that bears the toner images of the respective colors in a superimposed manner and carries the resulting toner image and a laser scanning unit 34 that is disposed below image forming units 26, 27, 28, and 29 and irradiates photosensitive drums 32 (described below) with laser beams.

Each of the image forming units 26, 27, 28, and 29 includes the photosensitive drum (image bearing member) 32, a charging unit 33 that is disposed opposite the periphery of the photosensitive drum 32, a developing unit 35 that is disposed downstream of the charging unit 33 in the rotation direction of the photosensitive drum 32 and opposite the periphery of the photosensitive drum 32, and a cleaning unit 36 that is disposed downstream of the developing unit 35 in the rotation direction of the photosensitive drum 32 and opposite the periphery of the photosensitive drum 32. It is noted that the photosensitive drums 32 is irradiated by the laser scanning unit 34 at a specific portion of the surface of photosensitive drums 32 downstream of a charging unit 33 and upstream of the developing unit 35 in the rotation direction of the photosensitive drums 32.

The photosensitive drum 32 in each of the image forming units 26, 27, 28, and 29 is rotated by a driving motor (not shown) counterclockwise in the drawing. The developing unit 35 of each of the image forming units 26, 27, 28, and 29 includes a developing device 51 in which a two-component developer containing one of the corresponding toners (black, yellow, cyan, and magenta toners) is stored.

The intermediate transfer unit 30 (the transfer unit 8) includes a driving roller 38 disposed near the image forming unit 26; a driven roller 39 disposed near the image forming unit 29; a tension roller 42 disposed above the image forming unit 28; the intermediate transfer belt 40 running over the driving roller 38, the driven roller 39, and the tension roller 42; and four primary transfer rollers 41 disposed downstream of the respective developing units 35 of the image forming units 26, 27, 28, and 29 in the rotation direction of the photosensitive drums 32 and pressed against the respective photosensitive drums 32 with the intermediate transfer belt 40 interposed therebetween.

In the intermediate transfer unit 30, at the positions of the primary transfer rollers 41 corresponding to the respective image forming units 26, 27, 28, and 29, the toner images of the respective colors are transferred from the corresponding photosensitive drums 32 and superimposed on one another on the intermediate transfer belt 40, and formed into a full-color toner image.

The first conveying path 9 and the second conveying path 10 are provided for guiding sheets fed from the paper feed cassette 5 and the stacking tray 6, respectively, toward the secondary transfer unit 23. The first conveying path 9 and the second conveying path 10 are provided with a plurality of conveying roller pairs 43 and the registration roller pair 22. The conveying roller pairs 43 are disposed at predetermined positions inside the apparatus main body 2. The registration roller pair 22 is disposed before the secondary transfer unit 23. The registration roller pair 22 is provided for adjusting the timing of a paper feed operation with respect to an image forming operation in the image forming section 7.

The fixing unit 14 fixes an unfixed toner image on a sheet onto which the toner image has been transferred in the image forming section 7, by applying heat and pressure to the sheet. In various embodiments, such as that illustrated, fixing unit 14 includes a fixing roller pair composed of a pressure roller 44 and a fixing roller 45. The pressure roller 44 has a metal core, an elastic surface layer (e.g., of silicone rubber) on the metal core, and a release layer (e.g., of perfluoro alkoxy ethylene (PFA)) on the elastic surface layer. The fixing roller 45 has a metal core and an elastic surface layer (e.g., of silicone sponge) on the metal core. The fixing unit 14 also includes a heat roller (heating member) 46 and a heating belt (heating member) 48. The heat roller 46 is disposed adjacent to the fixing roller 45. The heating belt 48 is looped around the heat roller 46 and the fixing roller 45 that are cylindrical in shape. The structure of the fixing unit 14 according to some embodiments will be described in detail later on.

In the sheet conveying direction, conveying paths 47 are provided both upstream and downstream of the fixing unit 14. A sheet that has been conveyed through the secondary transfer unit 23 is introduced, through the conveying path 47 on the upstream side, into a fixing nip between the pressure roller 44 and the heating belt 48. The sheet that has passed through the fixing nip between the pressure roller 44 and the heating belt 48 is conveyed along the conveying path 47 on the downstream side and guided to the third conveying path 11.

The third conveying path 11 guides a sheet that has been subjected to a fixing process in the fixing unit 14 to the discharge tray 1 For this, the third conveying path 11 is provided with a conveying roller pair 49 at an appropriate position and the discharge roller pair 24 at the exit thereof.

The fixing unit 14 included in the image forming apparatus 1 of the present illustrative embodiment will now be described in further detail.

Figure 2:
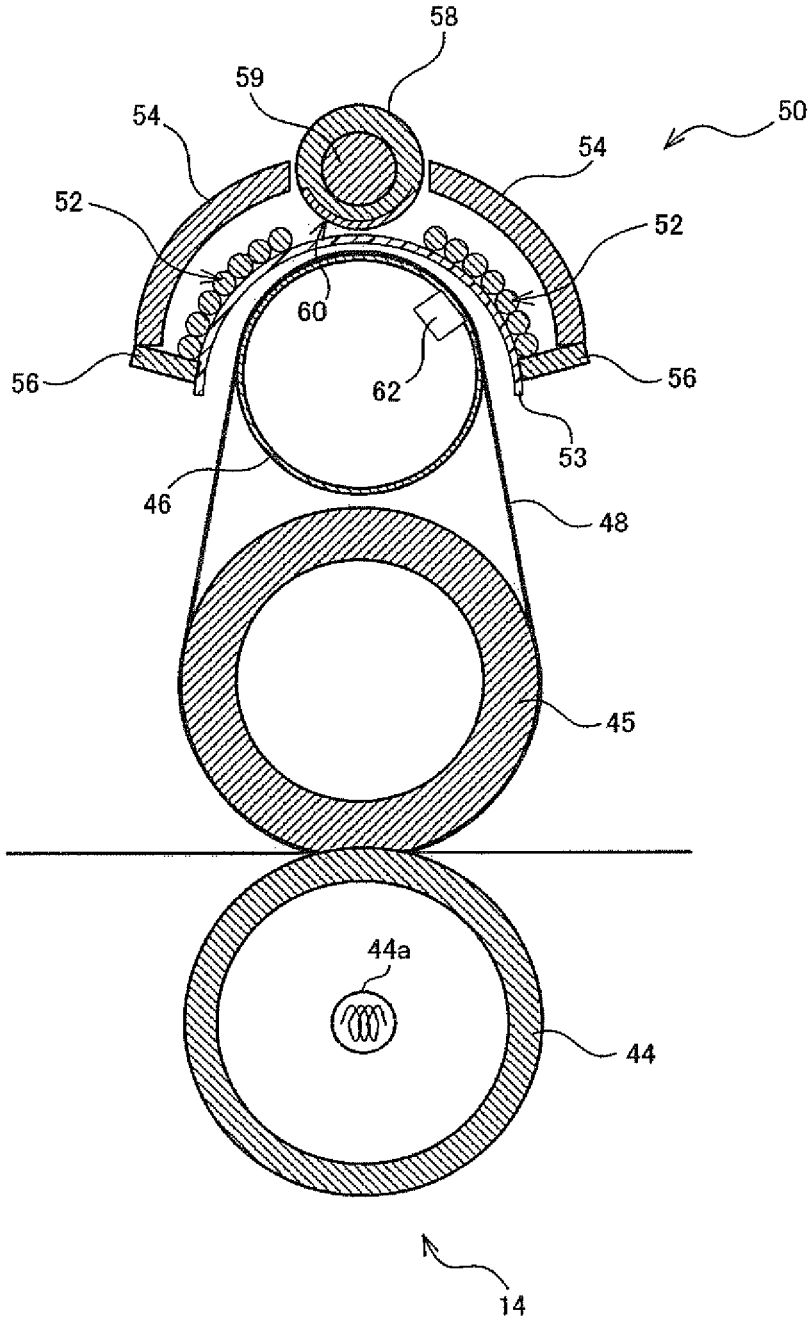
FIG. 2 is a horizontal sectional view illustrating a structure of a fixing unit according to some embodiments.

FIG. 2 is a horizontal sectional view illustrating a structure of the fixing unit 14 according to some embodiments. Note that the orientation of the fixing unit 14 illustrated in FIG. 2 is obtained by turning that of the fixing unit 14 illustrated in FIG. 1 (which illustrates a mounted state of the fixing unit 14) about 90 degrees counterclockwise. This means that the sheet conveying direction, which is upward in FIG. 1, is from right to left in FIG. 2. When, for example, the apparatus main body 2 has a large size (e.g., when the image forming apparatus 1 is a multi-functional peripheral), the fixing unit 14 may be mounted in the orientation illustrated in FIG. 2. Alternatively, the fixing unit 14 may be mounted in the apparatus main body 2 in a position tilted to the left or right of that illustrated in FIG. 2. In other words, relative to an axis along the paper width direction, fixing unit 14 may be mounted in any azimuthal orientation permitted by the apparatus design that may be implemented according to various embodiments, As described above, the fixing unit 14 of the present illustrative embodiment includes the pressure roller 44, the fixing roller 45, the heat roller 46, and the heating belt 48. In accordance with some embodiments, such as the present illustrative embodiment, the pressure roller 44 is a 50-mm-diameter roller that may be produced by forming a 4-mm-thick surface layer of silicone rubber on a metal (e.g., stainless used steel (SUS)) core and further forming a release layer (e.g., of PFA) on the surface layer. Also according to some embodiments, such as the present illustrative embodiment, the fixing roller 45 is a 45-mm-diameter roller that may be produced by forming an 8-mm-thick surface layer of silicone rubber sponge on a metal (e.g., SUS) core.

The heat roller 46 is a roller that may be produced by forming a mold release layer (e.g., of PFA) on a 30-mm-diameter 1-mm-thick metal core of magnetic metal (e.g., Fe). The heat roller 46 rotates by being driven by rotation of a rotating shaft (not shown).

The heating belt 48 may be produced by forming a 400-μm-thick thin-film elastic layer (e.g., of silicone rubber) (1 μm=1×10-6 m) on a surface of a substrate, which is a 35-μm-thick of ferromagnetic material (e.g., Ni electroformed substrate), and further forming a release layer (e.g., of PFA) on the outer surface of the elastic layer. The heat-generating temperature of the heating belt 48 may be adjusted to a range of about 150° C. to about 200° C. The heating belt 48 may be a resin belt, such as a polyimide (PI) belt, if not designed to have a heat-generating function.

As described above, since the fixing roller 45 has an elastic layer of silicone rubber sponge as a surface layer, a flat nip is formed between the heating belt 48 and the pressure roller 44. The pressure roller 44 has a hollow cylindrical shape. A halogen heater **44*a* is provided in an internal space of the pressure roller 44**.

The fixing unit 14 further includes an IH (induction heating) coil unit 50 (not shown in FIG. 1) outside the heat roller 46 and the heating belt 48. The IH coil unit 50 includes an induction heating coil 52, pairs of arch cores 54 (see also FIG. 3), a pair of side cores 56, and a center core (core unit) 58.

In some embodiments, such as the illustrative embodiment of FIG. 2, for induction heating in an arc-shaped portion of the heat roller 46 and the heating belt 48 in a cross sectional, the induction heating coil 52 is provided on a virtual arc-shaped surface (in cross section) that extends along an arc-shaped outer surface of the heat roller 46 and the heating belt 48 in cross section. A coil bobbin 53 is provided outside the heat roller 46 and the heating belt 48. The induction heating coil 52 is in the form of a winding on the coil bobbin 53. The coil bobbin 53 is molded in a semi-cylindrical shape extending along the outer surface of the heat roller 46. The coil bobbin 53 may, for example, be made of heat-resistant resin (e.g., polyphenylenesulfide (PPS) resin, polyethylene terephthalate (PET) resin, liquid crystal polymer (LCP) resin, or other resin). The induction heating coil 52 is secured to the coil bobbin 53, for example, with a silicone adhesive.

Referring to FIG. 2, the center core 58 is located in the center of the IH coil unit 50, and the arch cores 54 and the side cores 56 are arranged in pairs on both sides of the center core 58. The arch cores 54 are ferrite cores molded in an arched shape in cross section. The arch cores 54 are arranged in a symmetrical manner with respect to the center core 58. The overall length of each arch core 54 (the length of the arch core 54 in the sheet conveying direction) is greater than the length of a region where the induction heating coil 52 is disposed (see FIG. 3). The side cores 56 on both sides are ferrite cores molded in a block shape. Each side core 56 is coupled to one ends (lower end in FIG. 2) of the corresponding arch cores 54. The side cores 56 cover the outside of a region where the induction heating coil 52 is disposed.

Figure 3:
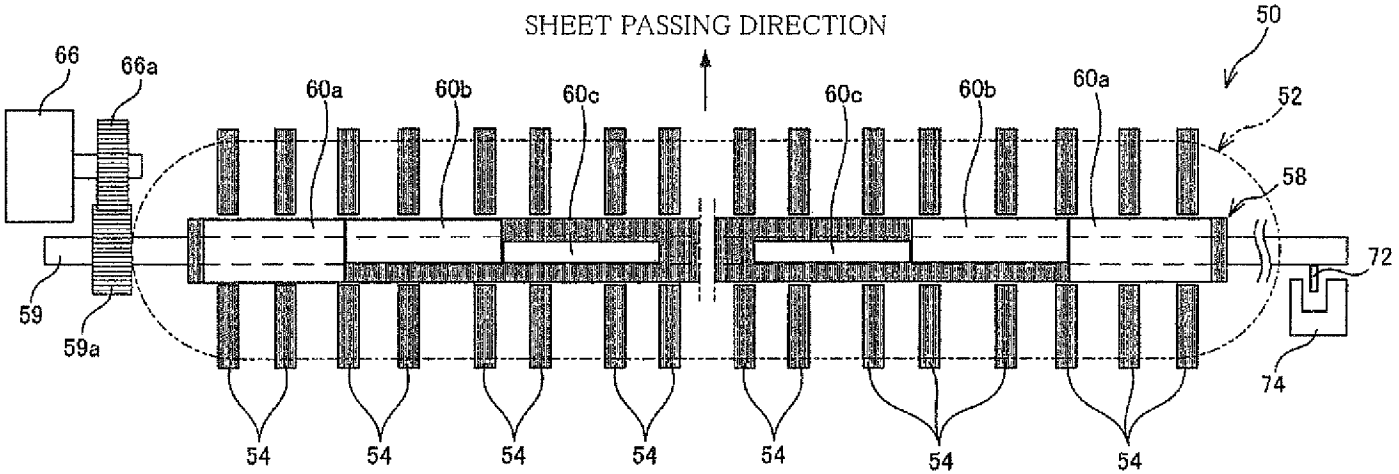
FIG. 3 is a plan view illustrating a center core and its surrounding components in detail according to some embodiments.

The arch cores 54 are spaced in the longitudinal direction of the center core 58 (see FIG. 3). In the present embodiment, each of the arch cores 54 is 10 mm in width in the longitudinal direction of the center core 58. In general, the higher the arrangement density of the arch cores 54, the better the performance of magnetic flux induction. However, the performance is not significantly degraded even if the arrangement density of the arch cores 54 is lowered to some extent. Therefore, according to some implementations, the arch cores 54 may be arranged at a density which provides sufficient performance in a cost-effective manner. The temperature distribution of the heating belt 48 in the axial direction can be adjusted by adjusting the arrangement density of the arch cores 54, such that the spacing between adjacent arch cores 54 may not be equal over the entire longitudinal extent but may vary as a function of the longitudinal position. In accordance with some embodiments, such as the present embodiment, the overall arrangement density of the arch cores 54 may be about ½ to about ⅓ of a region where the arch cores can be disposed, though greater or lesser overall arrangement densities are possible. In accordance with some embodiments, the arrangement density of the arch cores 54 at both ends in the longitudinal direction of the induction heating coil 52 may be set to be higher than that in the center area, which may provide for preventing a decrease in temperature in end regions of the heating belt 48 in the longitudinal direction The side cores 56 are composed of a plurality of individual side cores each being, for example, about 30 mm to about 60 mm in length in the longitudinal direction of the center core 58. In accordance with some embodiments, the individual side cores are arranged closely and continuously in the longitudinal direction of the heat roller 46 to form the center core 58 (there are no gaps between individual side cores facing each other). The overall length of the region where the side cores 56 are arranged corresponds to the region where the induction heating coil 52 is disposed. With this arrangement, where the plurality of individual side cores are arranged continuously in the longitudinal direction of the heat roller 46, it is possible to even out variations in temperature distribution associated with the arrangement of the arch cores 54. The arrangement of the arch cores 54 and the side cores 56 are determined in accordance with the distribution of magnetic fluxes (magnetic field strengths) of the induction heating coil 52. Since the arch cores 54 are spaced at certain intervals, the side cores 56 reinforce the magnetic focusing effect in places where the arch cores 54 are not disposed. It is thus possible to even out the magnetic flux distribution (and hence temperature distribution) in the longitudinal direction of the center core 58.

The arch cores 54 and the side cores 56 may be externally provided with a resin core holder (not shown), which supports the arch cores 54 and the side cores 56. The core holder is, for example, made of heat-resistant resin (e.g., PPS, PET, or LCP).

In the example of FIG. 2, the heat roller 46 is internally provided with a thermistor and a thermostat, as indicated by reference numeral 62. In the heat roller 46, the thermistor and the thermostat are arranged inside an area where the amount of heat generated by induction heating is particularly large. More practically, alternatively or additionally, a non-contact sensor which is not in contact with the heating belt 48 may be provided below the IH coil unit 50 so that the outer surface temperature of the heating belt 48 can be detected.

In accordance with some embodiments, the center core 58 illustrated in FIGS. 2 and 3 is a ferrite core that is a circle in cross section (e.g., about 18 mm in outside diameter). That is, the center core 58 is cylindrically-shaped. The center core 58 has a shaft 59 that extends axially in the center of the center core 58. The shaft 59 is, for example, made of non-magnetic metal (e.g., SUS) or heat-resistant resin (e.g., PPS, PET, or LCP). The center core 58 has substantially the same length as that of the heat roller 46. Specifically, in this illustrative embodiment, the center core 58 has a length that can accommodate a maximum sheet passing width of 13 inches (about 340 mm), though this length may vary according to alternative implementations designed to accommodate different maximum sheet passing widths.

The center core 58 is provided with a shielding member 60 that extends along the outer surface of the center core 58 in cross section. The shielding member 60 is a thin plate that is entirely curved in an arc shape. The shielding member 60 may be embedded in the center core 58 as illustrated in FIG. 2, or may be attached to the outer surface of the center core 58. The shielding member 60 can be attached to the center core 58 with, for example, a silicone adhesive.

The shielding member 60 may be made of, for example, non-magnetic material with good electrical conductivity, such as oxygen-free copper. When a magnetic field substantially perpendicular to the surface of the shielding member 60 penetrates the shielding member 60, an induced current flows in the shielding member 60. An opposing magnetic field in an opposite direction with regard to the penetrating magnetic flux is generated by the induced current and cancels the interlinkage magnetic flux (perpendicular penetrating magnetic field) to block or suppress magnetic flux from the induction heating coil 52. When a material with good electrical conductivity is used as a material of the shielding member 60, it is possible to suppress generation of Joule heat caused by the induced current in the shielding member 60 and thus to effectively block or suppress the magnetic flux. Examples of ways to improve electrical conductivity of the shielding member 60 are (1) to select a material with as small a specific resistance as possible, and (2) to increase the thickness of the shielding member 60. Specifically, in some embodiments, the thickness of the shielding member 60 may be 0.5 mm or more. In the present embodiment, by way of example, the thickness of the shielding member 60 is 1 mm.

As illustrated in FIG. 2, when the shielding member 60 is located at a position (shielding position) close to the surface of the heating belt 48, the magnetic resistance increases in the vicinity of the induction heating coil 52 and the magnetic field strength decreases in the vicinity of the induction heating coil 52. On the other hand, if the center core 58 illustrated in FIG. 2 turns 180 degrees around the shaft 59 of the center core 58 (in any direction) to bring the shielding member 60 to a position (retracted position) farthest from the heating belt 48, the magnetic resistance decreases in the vicinity of the induction heating coil 52. Magnetic paths, which extend from the center core 58 through the arch cores 54 and the side cores 56 on both sides of the center core 58, are created and magnetic flux acts on the heating belt 48 and the heat roller 46.

FIG. 3 is a plan view illustrating the center core 58 and its surrounding components in accordance with some embodiments. The center core 58 extends in the sheet width direction perpendicular to the sheet passing direction (indicated by an arrow in FIG. 3). The overall length of the center core 58 may be slightly greater than the maximum sheet passing width (13 inches).

The IH coil unit 50 is equipped with a stepping motor 66. The shaft 59 of the center core 58 is configured to be rotated by power from the stepping motor 66. A driven gear 59*a* is attached to one end of the shaft 59. An output gear 66*a* of the stepping motor 66 engages with the driven gear 59*a*. When the stepping motor 66 is driven, the power from the stepping motor 66 rotates the shaft 59 and the center core 58 rotates about the axis extending in the longitudinal direction.

To detect the rotation angle of the center core 58 (i.e., a rotational displacement of the center core 58 from a reference position), an index 72 is provided at the other end of the shaft 59. A photo-interrupter 74 is combined with the index 72. The position of the index 72 serves as a reference position for detecting the rotation angle of the center core 58. The index 72 interacts with the photo-interrupter 74 (e.g., by blocking light from the photo-interrupter 74) at the reference position.

The rotation angle of the center core 58 can be controlled by varying the number of driving pulses applied to the stepping motor 66. Therefore, the stepping motor 66 has a control unit (not shown) which includes a control integrated circuit (IC), an input driver, an output driver, and a semiconductor memory.

A detection signal from the photo-interrupter 74 is input through the input driver to the control IC, which detects the reference position for the center core 58 on the basis of this detection signal. On the other hand, the control IC receives information about the current sheet size from an image formation controller (not shown). Upon receipt of information, the control IC reads information about a rotation angle (i.e., an angle from the reference position) of the center core 58 from the semiconductor memory (read-only memory (ROM)). This rotation angle is a target rotation angle appropriate for the current sheet size. The control IC outputs, at predetermined intervals, driving pulses necessary to achieve the target rotation angle. The driving pulses are applied through the output driver to the stepping motor 66, which then operates in accordance with the driving pulses. The adjustment of the rotation angle of the center core 58 performed in accordance with various sheet sizes will be further described below.

In the example illustrated in FIG. 3, the shielding member 60 (see FIG. 2) described above is divided into three types of shielding members, first, second, and third shielding members 60*a*, 60*b*, and 60*c* arranged in the axial direction (longitudinal direction) of the center core 58. In accordance with various embodiments, such as the present illustrative embodiment, shielding members 60*a*, 60*b*, and 60*c* have different lengths and arrangements in the axial direction of the center core 58, and have different lengths in the circumferential direction of the center core 58 (i.e., different widths over which the center core 58 is covered). The shielding members 60*a*, 60*b*, and 60*c* will be described in detail below. Note that the shielding members 60*a*, 60*b*, and 60*c* may be provided as a single integral member, instead of being arranged separately.

Figures 4A, 4B, 4C, 4D, 4E, 4F, 4G:
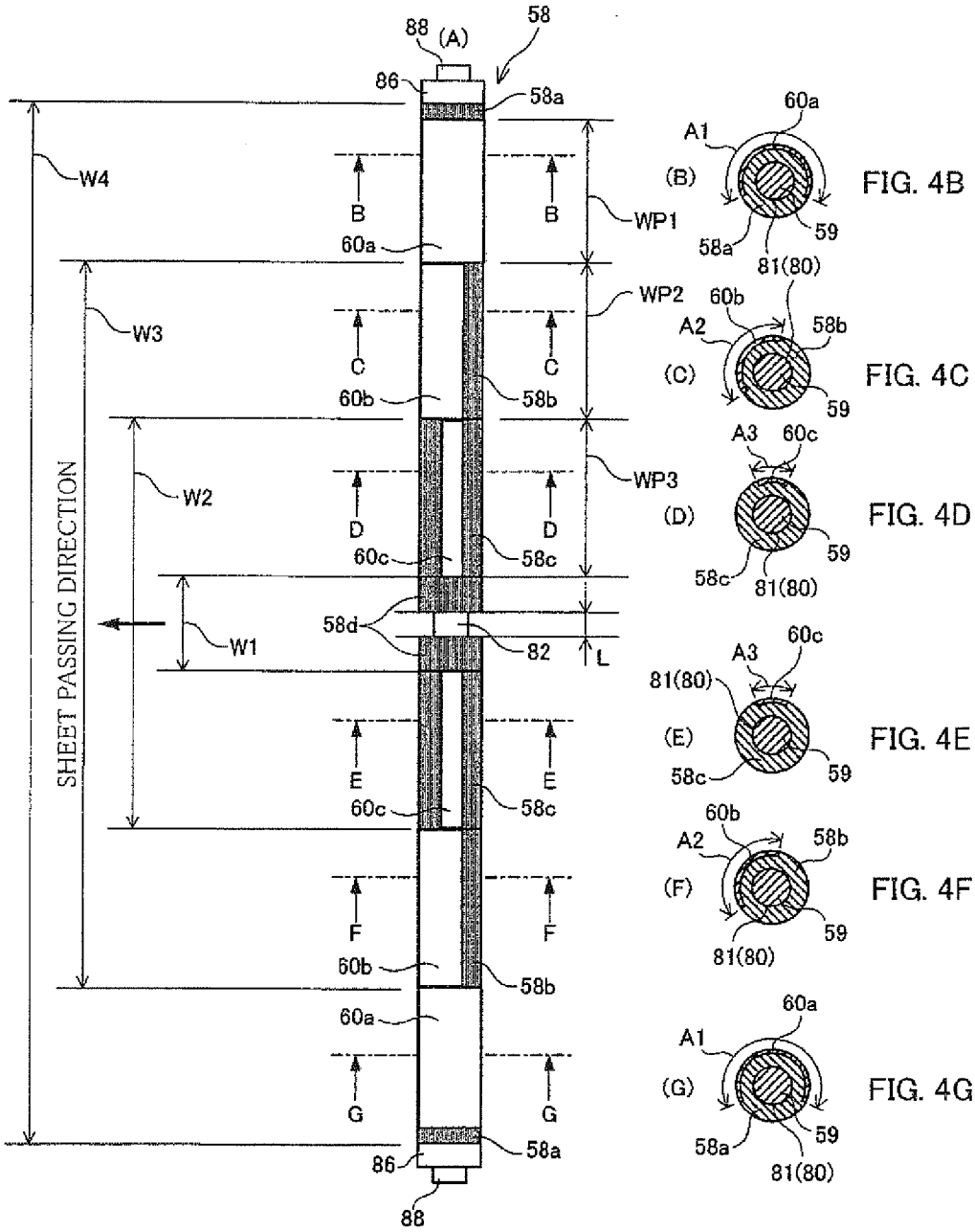
FIG. 4A is a plan view of the center core according to some embodiments.
FIGS. 4B to 4G are corresponding cross-sectional views of the center core according to some embodiments.

FIGS. 4A to 4G illustrate arrangements and lengths of the shielding members 60*a*, 60*b*, and 60*c* in the axial direction, and widths of the shielding members 60*a*, 60*b*, and 60*c* in the circumferential direction, with respect to the center core 58. As illustrated in FIG. 4A, in the axial direction of the center core 58, the three types of shielding members 60*a*, 60*b*, and 60*c* are arranged in a symmetrical manner with respect to the center in the sheet width direction. The first shielding members 60*a* are arranged at both ends of the center core 58, the second shielding members 60*b* are arranged immediately inside the respective first shielding members 60*a*, and the third shielding members 60*c* are arranged immediately inside the respective second shielding members 60*b*.

The innermost third shielding members 60*c* (i.e., closest to the center) are arranged outside a region of a sheet passing width W1 corresponding to a minimum sheet size. The second shielding members 60*b* are arranged outside a region of a sheet passing width W2 corresponding to a medium sheet size. The first shielding members 60*a* are arranged outside a region of a sheet passing width W3 corresponding to a sheet size one size larger than the medium one. With above illustrative arrangement, the shielding member 60 can correspond to sheets of a total of four different sizes (or four different maximum sheet sizes or size ranges) corresponding to the sheet passing widths W1 to W4 in FIG. 4. For example, the four different sheet sizes may be a maximum sheet size of 13 inches (340 mm) and three smaller sheet sizes of A3 (297 mm), A4 portrait (210 mm), and A5 portrait (149 mm). Axial lengths WP1, WP2, and WP3, respectively, are set in accordance with the corresponding sheet sizes.

In the present illustrative embodiment, in fact, the boundaries of the shielding members 60*a*, 60*b*, and 60*c* are set such that the shielding members 60*a*, 60*b*, and 60*c* extend about 10±5 mm inward from the boundaries defined by the sheet passing widths W3, W2, and W1, respectively. The reason the shielding members 60*a*, 60*b*, and 60*c* are formed to slightly enter the regions defined by the sheet passing widths W3, W2, and W1, respectively, is that temperature in the non-sheet-passing region is typically higher than that in the sheet passing region and it is necessary to consider the possible transfer of heat from the non-sheet-passing region to the sheet passing region. In accordance with some implementations, when the shielding members 60*a*, 60*b*, and 60*c* extend into the corresponding sheet passing regions to the extent described above, it may be easier to flatten the temperature distribution in boundary regions.

In accordance with some embodiments, for accommodating four different sized sheets, the widths of the shielding members 60*a*, 60*b*, and 60*c* in the circumferential direction may be set as follows.

Referring to FIGS. 4B and 4G, the width of the first shielding members 60*a* in the circumferential direction is set to correspond to a central angle A1 (240 degrees) of the center core 58.

Referring to FIGS. 4C and 4F, the width of the second shielding members 60*b* in the circumferential direction is set to correspond to a central angle A2 (160 degrees) of the center core 58.

Referring to FIGS. 4D and 4E, the width of the third shielding members 60*c* in the circumferential direction is set to correspond to a central angle A3 (80 degrees) of the center core 58.

Figure 5A:
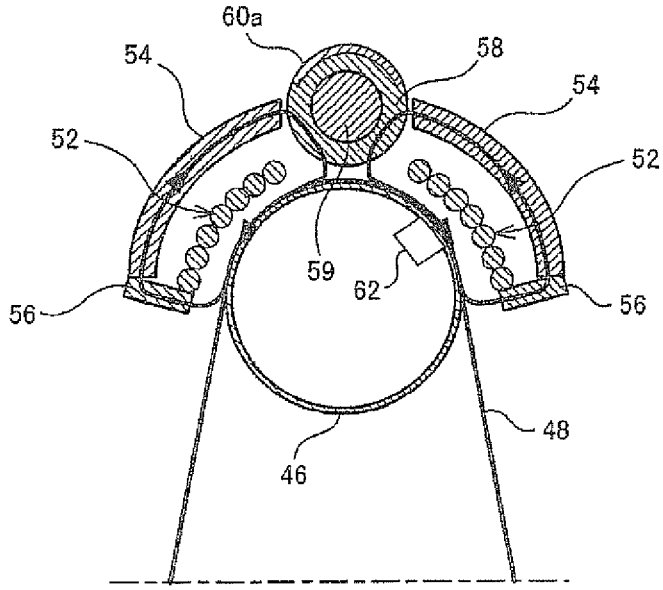
FIGS. 5A and 5B illustrate operations that occur as the center core rotates according to some embodiments.
Figure 5B:
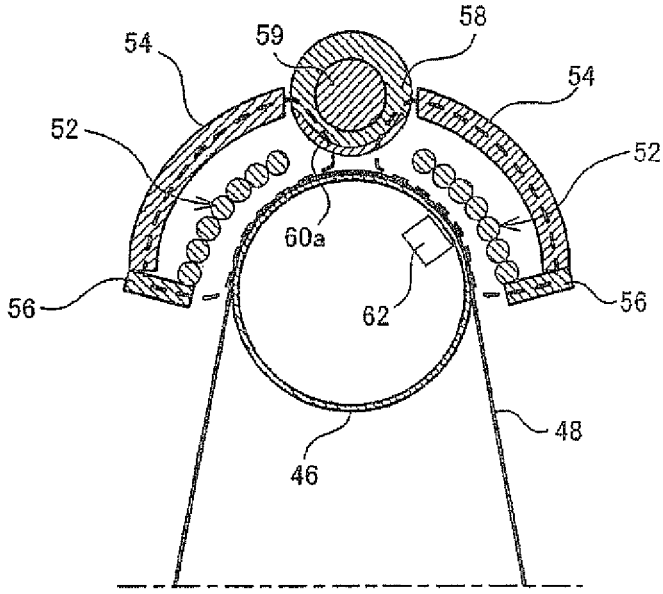

FIGS. 5A and 5B illustrate operations that occur as the center core 58 rotates. For convenience of explanation, the coil bobbin 53 is omitted in FIG. 5. Although for clarity of exposition the first shielding members 60*a* will be described as an example, the same applies to the second and third shielding members 60*b* and 60*c*.

FIG. 5A illustrates an operation that occurs when the first shielding members 60*a* on both sides of the center core 58 are moved to the retracted positions as the center core 58 rotates. In the illustrated state, magnetic flux generated by the induction heating coil 52 passes through the side cores 56, the arch cores 54, the center core 58, the heating belt 48, and the heat roller 46. The magnetic flux causes eddy currents to be generated in the heating belt 48 and the heat roller 46, which are made of ferromagnetic materials. The heating belt 48 and the heat roller 46 are thus heated by Joule heat generated by eddy currents which flow in the heating belt 48 and the heat roller 46 having specific resistances of the respective materials.

FIG. 5B illustrates an operation that occurs when the first shielding members 60*a* are moved to the shielding positions as the center core 58 rotates. In the illustrated state, since the first shielding members 60*a* are located on the magnetic path at both ends of the center core 58 (outside the sheet passing region), transmission of magnetic flux is partially suppressed. Thus, since the amount of heat generation in the heating belt 48 and the heat roller 46 can be reduced in the non-sheet-passing region, it is possible to prevent overheating of the heating belt 48 and the heat roller 46.

Figure 6:
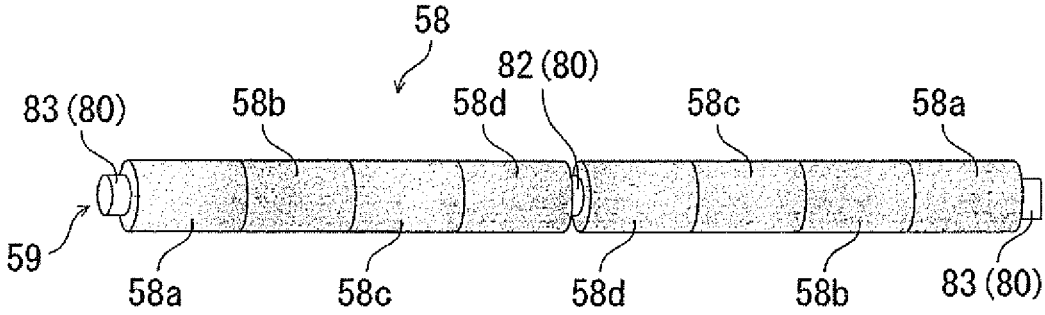
FIG. 6 illustrates a structure of the center core according to some embodiments.

In accordance with some embodiments, such as the present embodiment, the center core 58 is divided into smaller parts in the width direction of sheets to be conveyed; that is, in the same direction as the rotational axis of the center core 58. Specifically, as illustrated in FIGS. 4A and 6, in the present illustrative embodiment a total of eight core bodies, composed of two each of core bodies 58*a*, 58*b*, 58*c*, and 58*d*, are arranged along the shaft 59. For each pair of core bodies 58*a*, 58*b*, 58*c*, and 58*d*, the two core bodies are arranged in a symmetrical manner in the axial direction of the center core 58.

The shaft 59 has an outer surface 80 on which the core bodies 58*a*, 58*b*, 58*c*, and 58*d* and caps 86 are arranged; and a shaft core 88 (see FIG. 4A) extending from both ends of the outer surface 80 in the direction of the rotational axis of the shaft 59 and rotatably supported by the coil bobbin 53. In the present embodiment, the outer surface 80 has retaining portions 81 (see FIGS. 4B to 4G) that retain the eight core bodies 58*a*, 58*b*, 58*c*, and 58*d*; a gap portion 82 (see FIGS. 4A and 6) that is located between the core bodies 58*d* spaced apart by a gap length L; and end portions 83 (FIG. 6) that hold the respective caps 86. For clearer illustration of the end portions 83, the caps 86 are omitted in FIG. 6.

The caps 86 engage with and are secured to respective cut portions of the shaft core 88 and end faces of the core bodies 58*a*, the cut portions having a D-shape in cross section. Therefore, the core bodies 58*a* can be prevented from falling out. The positions at which the caps 86 and the respective end faces of the core bodies 58*a* are in contact serve as references for positioning of the center core 58. That is, the core bodies 58*a* having the first shielding members 60*a* are arranged at both ends of the outer surface 80 of the shaft 59. Then, from the core bodies 58*a* toward the center, the core bodies 58*b* having the second shielding members 60*b*, the core bodies 58*c* having the third shielding members 60*c*, and the core bodies 58*d* having no shielding member 60 are sequentially arranged.

Thus, the gap portion 82 of the present illustrative embodiment is defined at the center of sheet passing width W1 corresponding to the minimum sheet size. That is, the gap portion 82 is provided between the core bodies 58*d* having no shielding member 60 (see FIGS. 4A and 6).

In this illustrative embodiment, the radial tolerances and axial tolerances of core bodies, which are sintered products, are about ±0.2 mm. The gap portion 82 has a size (L) of about 4.0 mm, which is greater than the sum of axial tolerances of the eight core bodies 58*a*, 58*b*, 58*c*, and 58*d*. Accordingly, in this illustrative embodiment, the gap portion 82 is large enough to be easily seen.

Figure 7:
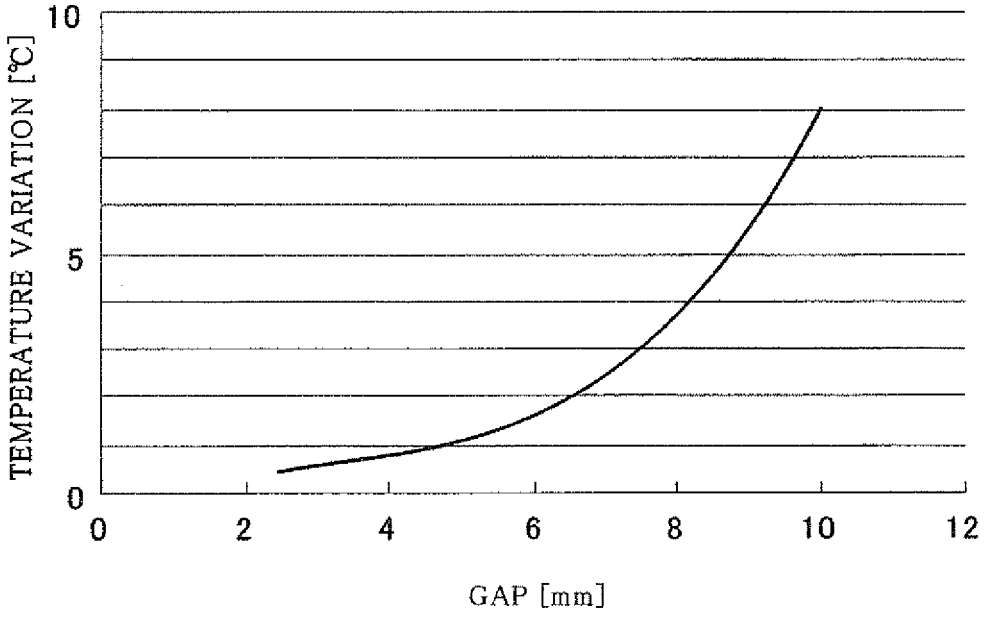
FIG. 7 is a graph showing an illustrative relationship between temperature variation and gap size according to some embodiments.
Figure 8A:
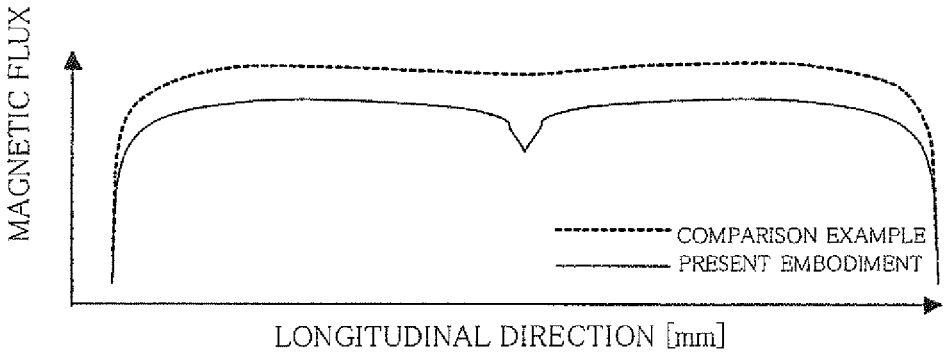
FIG. 8A illustrates a magnetic flux distribution in the axial direction of the center core according to some embodiments.

As shown in FIG. 7, temperature variation in the heating belt 48 and the heat roller 46 increases as a gap size increases. In particular, in an example, the curve representing temperature difference becomes steep when the gap size exceeds 6.0 mm. In view of this, for various such implementations, it may be preferable that the size of the gap portion 82 be 6.0 mm or less. FIG. 8A illustrates a magnetic flux distribution in the axial direction (longitudinal direction) of the center core 58. In FIG. 8A, a broken line and a solid line correspond to a comparison example and the present embodiment, respectively. In the comparison example where the gap portion 82 is not provided, the magnetic flux distribution is substantially constant in the center portion of the center core 58. On the other hand, in the present embodiment, since the magnetic flux density that passes through the heating belt 48 etc. is reduced at the location of the gap portion 82, the magnetic flux distribution drops at the center portion of the center core 58.

Figure 8B:
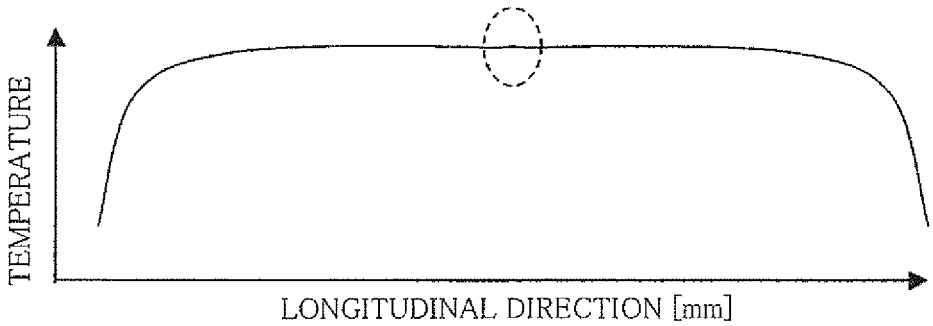
FIG. 8B illustrates a temperature distribution in the axial direction of the center core in the heated condition according to some embodiments.

However, in this illustrative embodiment, if the size of the gap portion 82 is within the range described above (e.g., between about 4.0 mm and 6.0 mm; less than a size where temperature differences become significant or steep or may result in deleterious temperature effects, while greater than the sum of axial tolerances of the eight core bodies), the resulting temperature variation does not affect fixing performance. FIG. 8B illustrates a distribution of temperatures of the heating belt 48 in the axial direction (longitudinal direction) of the center core 58. It is noted that the distribution of temperatures of the heating belt 48 of the present embodiment is essentially the same as that of the comparison example; thus, only a solid line, which indicates the distribution of temperatures of the present embodiment, can be seen in FIG. 8B. In FIG. 8B, a portion circled with a dotted line is slightly raised in the comparison example. In the present embodiment, as indicated by the solid line in FIG. 8B, the portion circled with a dotted line is not raised, but flat because the distribution of temperatures of the heating belt 48 is not influenced by the drop in magnetic flux distribution. In the temperature distribution, the raised portion in the comparison example is not clearly noticeable in FIG. 8B. This means that the presence of the gap portion 82 in the present embodiment does not affect the fixing performance.

Figure 9:
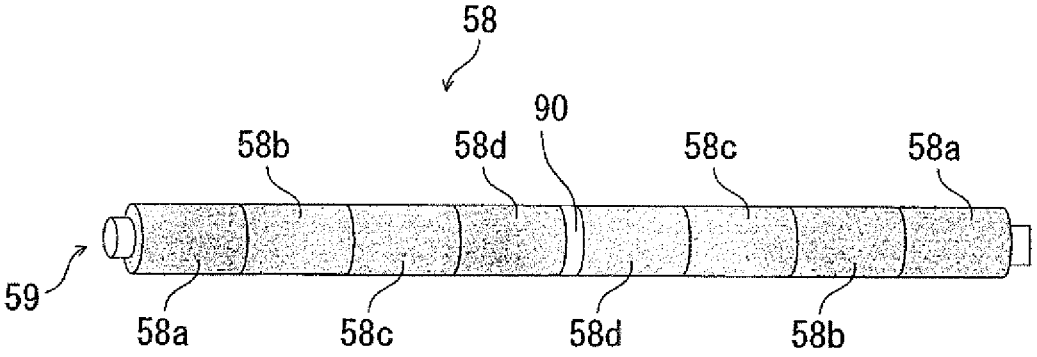
FIG. 9 illustrates another structure of the center core according to some embodiments.

In accordance with some embodiments, the gap portion 82 described above may be filled with an elastic member. In the example of FIG. 9, where the eight core bodies 58*a*, 58*b*, 58*c*, and 58*d* are arranged on the shaft 59 with reference to both ends as in the embodiment described above, a silicone sponge (elastic member) 90 is provided between the adjacent core bodies 58*d*. In some embodiments, when the core bodies 58*a*, 58*b*, 58*c*, and 58*d* are pressed against both sides by the elastic member, which may be a spring made of material which does not affect a magnetic field when placed in position, it is possible to omit the process of bonding the core bodies 58*a*, 58*b*, 58*c*, and 58*d* together.

Although the gap portion 82 described above is provided between the adjacent core bodies 58*d*, the position of the gap portion 82 is not necessarily limited to the center of the region of the sheet passing width W1 corresponding to the minimum sheet size. For example, the gap portion 82 may be provided near, but displaced from, the center of the sheet passing width W1.

In the embodiments described above, an external IH method is used in which a toner image is heated and fused by induction heating where the heating belt 48 and the heat roller 46 are heated by magnetic flux generated by the induction heating coil 52. When the center core 58 is divided into the separate core bodies 58*a*, 58*b*, 58*c*, and 58*d*, each of the core bodies 58*a*, 58*b*, 58*c*, and 58*d* can be formed into a simple shape which makes high processing accuracy and high dimensional accuracy easily achievable.

As described above, the separate core bodies 58*a*, 58*b*, 58*c*, and 58*d* are arranged on the outer surface 80 of the shaft 59. In accordance with some embodiments, the shaft 59 is designed to be longer than the total length of all the core bodies 58*a*, 58*b*, 58*c*, and 58*d* including their axial tolerances. At a position between the two adjacent core bodies 58*d*, the outer surface 80 has the gap portion 82 where no core body is provided.

That is, accordingly, the sum of the lengths of all the core bodies 58*a*, 58*b*, 58*c*, and 58*d* is smaller than the length of the outer surface 80 of the shaft 59 by the gap length L (see FIG. 4A). Even when all the core bodies 58*a*, 58*b*, 58*c*, and 58*d* are arranged on the outer surface 80, the core bodies 58*a* arranged at both ends do not extend beyond the corresponding ends of the outer surface 80. Therefore, in the present embodiment, it is only necessary to simply mount the eight core bodies 58*a*, 58*b*, 58*c*, and 58*d* on the outer surface 80. Since this makes it possible to eliminate the processing and selecting operations conventionally required to adjust the axial lengths of core bodies, the center core 58 with improved assembly features can be realized.

Since there is no core body in the gap portion 82, the magnetic flux passing through the heating belt 48 etc. may be reduced, which may lead to a reduced amount of heat generation. However, when the core bodies 58*a*, 58*b*, 58*c*, and 58*d* are arranged with respect to both ends of the outer surface 80, the gap portion 82 cannot be provided at both ends of the outer surface 80; in other words, the gap portion 82 cannot be provided in a region corresponding to a maximum sheet size. Therefore, it is possible to prevent degradation in heating efficiency of the heating belt 48 etc. in this region.

When the gap portion 82 is provided in or around the center of a region corresponding to a minimum sheet size, it is possible to reliably prevent degradation in heating efficiency of the heating belt 48 etc. in a region corresponding to a maximum sheet size most distant from the center portion. At the same time, temperature variation does not become noticeable to an extent which may affect fixing performance. Specifically, it is possible to prevent uneven heat generation over the heating belt 48 etc. in the axial direction, and realize uniform heat generation over the heating belt 48 etc. (see FIG. 8B). This can contribute to reduced manufacturing costs, reduced warm-up time, and/or energy saving.

When the gap portion 82 is provided in one place, two adjacent core bodies 58*a*, 58*b*, 58*c*, and 58*d*, except between the core bodies 58*d*, can be bonded and secured to each other in accordance with some embodiments such as the present embodiment. Therefore, unlike in the case where a plurality of gaps are provided in different places, it is not necessary to bond the core bodies 58*a*, 58*b*, 58*c*, and 58*d* to the outer surface 80 of the shaft 59. This makes it easier to mount the core bodies 58*a*, 58*b*, 58*c*, and 58*d* on the outer surface 80 of the shaft 59. It is noted that the gap portion can be divided into two or more when the core body between divided gaps is bonded to the shaft 59 or the core bodies between divided gaps are bonded to the shaft 59.

As described above, it is possible not only to provide the center core 58 with improved assembly features, but also to ensure good heat-generating performance of the heating belt 48 etc. and realize formation of high-quality toner images. Thus, the reliability of the image forming apparatus 1 can be improved.

The present disclosure is not limited to the embodiments described above, but may be carried out in various modified forms. For example, the core unit may either be a rotatable center core or a fixed center core. The configuration of the core unit may be modified as appropriate.

Although the image forming apparatus is embodied as a printer in the embodiments described above, it is to be understood that the image forming apparatus of the present disclosure is applicable to multifunctional peripherals, copiers, and facsimiles. Also, dimensions and/or dimensional ranges provided in the foregoing embodiments are merely illustrative and are not intended to be limiting of the present invention.

Having thus described in detail embodiments of the present invention, it is to be understood that the invention disclosed by the foregoing paragraphs is not to be limited to particular details and/or embodiments set forth in the above description, as many apparent variations thereof are possible without departing from the spirit or scope of the present invention.

What is claimed is:

1. A fixing device that fixes an image on a recording medium, the fixing device comprising:

a coil disposed along an outer surface of a heating member and configured to generate magnetic flux for heating the heating member through induction heating; and a core unit being configured to constitute a part of a magnetic path around the coil, wherein the core unit includes a plurality of core bodies arranged in a width direction of the recording medium to be conveyed, the core bodies being made of magnetic material; and a shaft having an outer surface on which the plurality of core bodies are arranged, a length of the outer surface being longer than a sum of lengths of the plurality of core bodies arranged on the outer surface, the core body lengths including axial tolerances of the plurality of core bodies, wherein a gap is provided between any adjacent ones of the plurality of core bodies arranged on the shaft, and wherein the gap is located in or around a center of a sheet passing region of a recording medium having a minimum printable size.

2. The fixing device according to claim 1, wherein the plurality of core bodies are arranged on the shaft with reference to both axial ends of the outer surface.

3. The fixing device according to claim 1, wherein the gap is provided with an elastic member in contact with the adjacent core bodies.

4. The fixing device according to claim 3, wherein the elastic member is a spring member.

5. The fixing device according to claim 4, further comprising caps, wherein the shaft has a shaft core; the caps engage with and are secured to respective ends of the shaft core; of the plurality of core bodies arranged on the shaft, the outermost core bodies in an axial direction of the shaft engage with and are secured to the respective caps; and the core bodies arranged inside the outermost core bodies are secured in position by being pressed toward the corresponding caps by the spring member.

6. The fixing device according to claim 1, further comprising caps, wherein the shaft has a shaft core; the caps engage with and are secured to respective ends of the shaft core; and of the plurality of core bodies arranged on the shaft, the outermost core bodies in an axial direction of the shaft engage with and are secured to the respective caps.

7. The fixing device according to claim 6, wherein the core bodies arranged inside the outermost core bodies are sequentially bonded and secured to the outermost core bodies.

8. The fixing device according to claim 1, wherein a length of the gap is about 6.0 mm or less.

9. The fixing device according to claim 1, wherein the length of the gap is approximately equal to or greater than the sum of the axial tolerances of the plurality of core bodies.

10. An image forming apparatus comprising:

an image forming section including at least one image bearing member bearing a toner image thereon;

a transfer unit configured to transfer a toner image formed on the image bearing member onto a recording medium; and a fixing device configured to fix the toner image on the recording medium, the toner image having been transferred onto the recording medium by the transfer unit, wherein the fixing device includes a coil disposed along an outer surface of a heating member and configured to generate magnetic flux for heating the heating member through induction heating; and a core unit being configured to constitute a part of a magnetic path around the coil, wherein the core unit includes a plurality of core bodies arranged in a width direction of the recording medium to be conveyed, the core bodies being made of magnetic material; and a shaft having an outer surface on which the plurality of core bodies are arranged, the outer surface being longer than a sum of lengths of the plurality of core bodies arranged on the outer surface, the core body lengths including axial tolerances of the plurality of core bodies wherein a gap is provided between any adjacent ones of the plurality of core bodies arranged on the shaft, and wherein the gap is located in or around a center of a sheet passing region of a recording medium having a minimum printable size.

11. The image forming apparatus according to claim 10, wherein the plurality of core bodies are arranged on the shaft with reference to both axial ends of the outer surface.

12. The image forming apparatus according to claim 10, wherein the gap is provided with an elastic member in contact with the adjacent core bodies.

13. The image forming apparatus according to claim 12, wherein the elastic member is a spring member.

14. The image forming apparatus according to claim 13, further comprising caps, wherein the shaft has a shaft core; the caps engage with and are secured to respective ends of the shaft core; of the plurality of core bodies arranged on the shaft, the outermost core bodies in an axial direction of the shaft engage with and are secured to the respective caps; and the core bodies arranged inside the outermost core bodies are secured in position by being pressed toward the corresponding caps by the spring member.

15. The image forming apparatus according to claim 10, further comprising caps, wherein the shaft has a shaft core; the caps engage with and are secured to respective ends of the shaft core; and of the plurality of core bodies arranged on the shaft, the outermost core bodies in an axial direction of the shaft engage with and are secured to the respective caps.

16. The image forming apparatus according to claim 15, wherein the core bodies arranged inside the outermost core bodies are sequentially bonded and secured to the outermost core bodies.

17. The image forming apparatus according to claim 10, wherein a length of the gap is 6.0 mm or less.

18. The image forming apparatus according to claim 10, wherein the length of the gap is approximately equal to or greater than the sum of the axial tolerances of the plurality of core bodies.

19. A fixing device that fixes an image on a recording medium, the fixing device comprising:

a coil disposed along an outer surface of a heating member and configured to generate magnetic flux for heating the heating member through induction heating; and a core unit being configured to constitute a part of a magnetic path around the coil, wherein the core unit includes a plurality of core bodies arranged in a width direction of the recording medium to be conveyed, the core bodies being made of magnetic material; and a shaft having an outer surface on which the plurality of core bodies are arranged, a length of the outer surface being longer than a sum of lengths of the plurality of core bodies arranged on the outer surface, the core body lengths including axial tolerances of the plurality of core bodies, wherein a gap is provided between any adjacent ones of the plurality of core bodies arranged on the shaft, and wherein the gap is provided with an elastic member in contact with the adjacent core bodies.

* * * * *